US005181722A

United States Patent [19]

Krutsch et al.

[11] Patent Number: 5,181,722

[45] Date of Patent: Jan. 26, 1993

[54] MOVABLE OPTICAL TARGET BANK FOR A ROLLING BALL GAME

[75] Inventors: John R. Krutsch, Glenview; Manu Jayswal, Bloomingdale, both of Ill.

[73] Assignee: William Electronics Games, Inc., Chicago, Ill.

[21] Appl. No.: 847,355

[22] Filed: Mar. 6, 1992

[51] Int. Cl.[5] ..... A63B 71/00; A63F 7/30

[52] U.S. Cl. ..... 273/127 B; 173/127 R; 173/119 A; 173/121 A; 173/118 A

[58] Field of Search ..... 273/118 R, 118 A, 118 D, 273/119 R, 119 A, 119 B, 120 R, 120 A, 121 R, , 121 A, 121 B, 122 R, 122 A, 123 R, 123 A, 124 R, 124 A, 127 R, 127 B

[56] References Cited

U.S. PATENT DOCUMENTS 3,642,284 2/1972 Kordek ..... 273/127 R 3,927,884 12/1975 Glass et al. ..... 273/127 R X

*Primary Examiner*—V. Millin

*Assistant Examiner*—Raleigh W. Chiu

*Attorney, Agent, or Firm*—Rockey, Rifkin and Ryther

[57] ABSTRACT

A pinball game playfield feature includes a circular table which is rotated by a motor and linkage. Mounted on the table is a target housing having optical emitters disposed therein. Optical detectors are located in the table. Each emitter-detector pair forms a light beam which can be interrupted by a pinball to signal the game microprocessor for scoring or other purposes. Rotation of the table permits selectable positioning of the optical target bank.

11 Claims, 3 Drawing Sheets

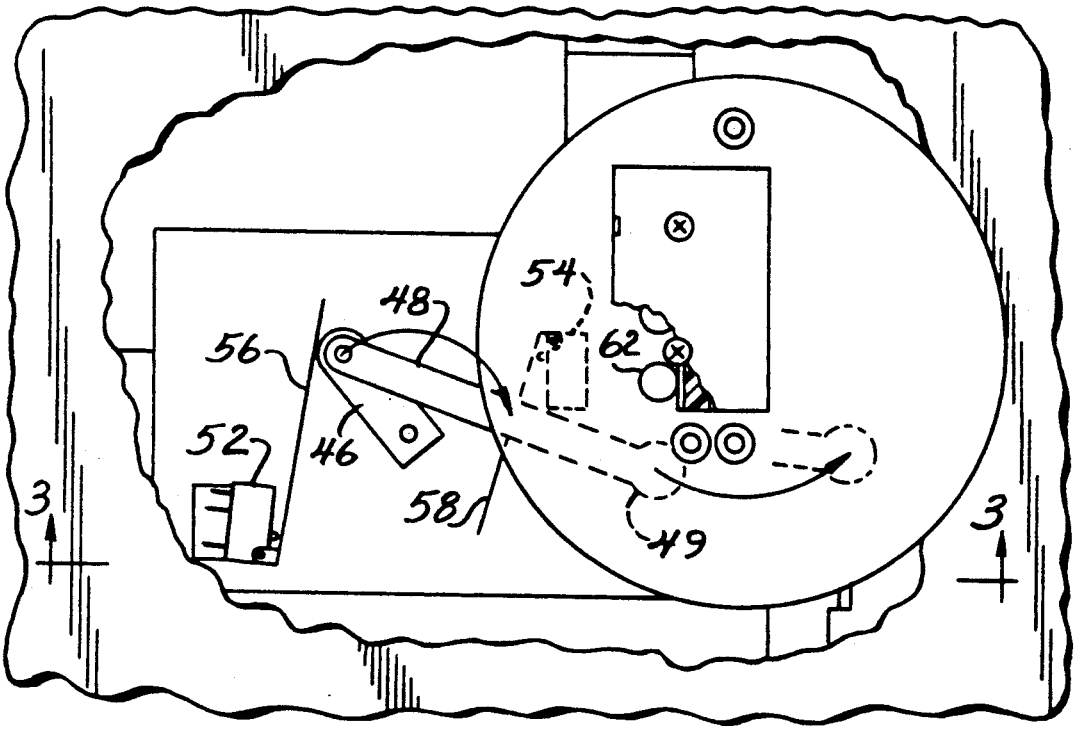
FIG. 2
FIG. 3
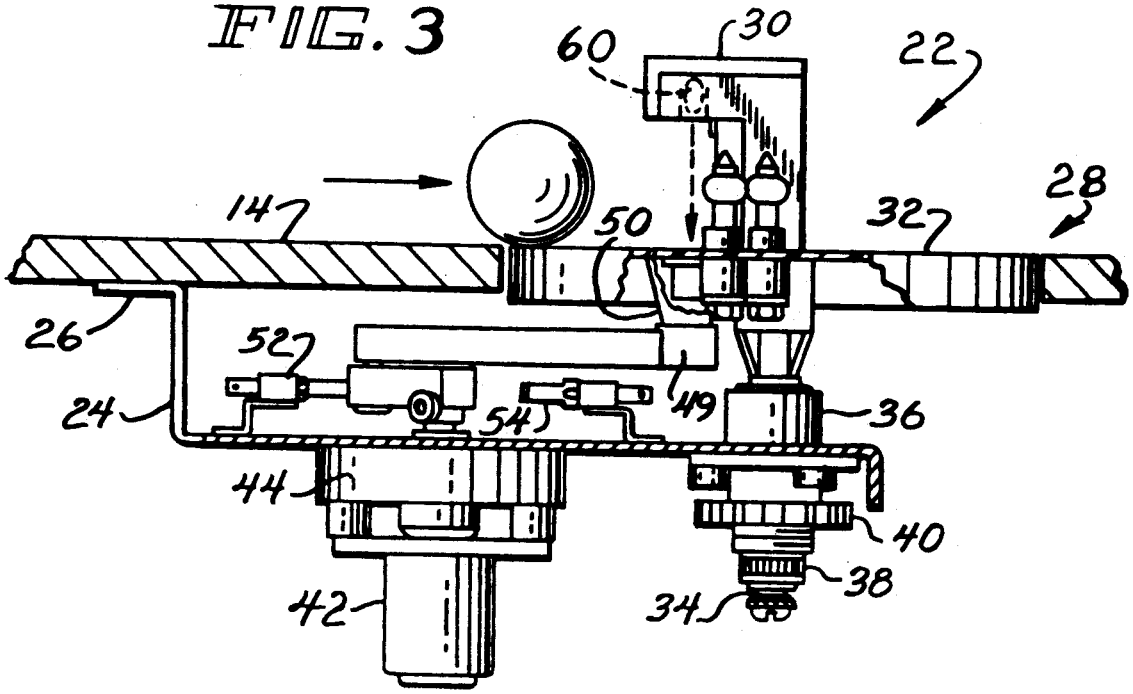

MOVABLE OPTICAL TARGET BANK FOR A ROLLING BALL GAME

BACKGROUND OF THE INVENTION

This invention relates to rolling ball games in general and to playfield features for such games in particular. Games of this type include the familiar pinball game and various novelty games, wherein a ball rolls on a playfield, usually wooden, and the player attempts to cause the ball to strike various targets or other features disposed on the playfield. Such features can include ramps, outholes, bumpers and the like. Such games are usually coin-operated and in order to induce players to operate the games, it is necessary that they be carefully designed to enhance and maintain player interest. For that purpose, there is an unremitting desire to develop new and unique playfield features which will both entertain and challenge the player.

One class of playfield features is generally referred to as a target bank. A target bank, heretofore, has consisted of a series of stand-up targets grouped in clusters of two or more. Each target has associated therewith a switch whereby when the ball strikes a target, the switch is actuated, signalling the game microprocessor. In turn, this causes points to be awarded, bonuses to be earned or special features to be actuated all according to the rules programmed in the game processors memory. Such target banks employ a mechanical structure disposed on or above the playfield at which the player aims. Upon striking the target, a micro-switch or similar device is actuated for the purposes indicated.

According to the present invention a novel type of target bank is disclosed not heretofore available in the prior art. The present invention discloses a target bank which is optical, rather than electro-mechanical in nature and which rotates. In a first position, the target bank is available to the player who may direct his ball at the bank in order to make the various target combinations. In a second position, the target bank is rotated so that the player cannot aim at the target bank. This permits access to a portion of the playfield which can otherwise be restricted from the player. Restated, the rotating target bank of the present invention is a combinational feature which can be used to restrict access to a portion of the playfield so that the player can have access thereto only when he "makes" all of the targets in the bank. This adds a creative challenge which enhances player interest in games of this type.

It is accordingly an object of the present invention to provide a new and improved playfield feature for rolling ball games.

It is a further object of the present invention to provide a novel type of target bank for rolling ball games in which optical targets are provided rather than mechanical or electro-mechanical targets.

A still further object of the invention is to provide a rotating optical target bank which permits a player to shoot at the targets in the bank in a first position and which can be rotated to a second position permitting access to an otherwise restricted area of the playfield which may have additional playfield features disposed thereon.

These and other objects of the invention will become apparent to those skilled in the art from the detailed description of the invention provided below.

BRIEF DESCRIPTION OF THE DRAWINGS

FIG. 2 is a plan view, having portions partially cut away, of the target bank according to the present invention.

FIG. 3 is a side sectional view along the lines 3—3 of FIG. 2.

DETAILED DESCRIPTION

Figure 1:
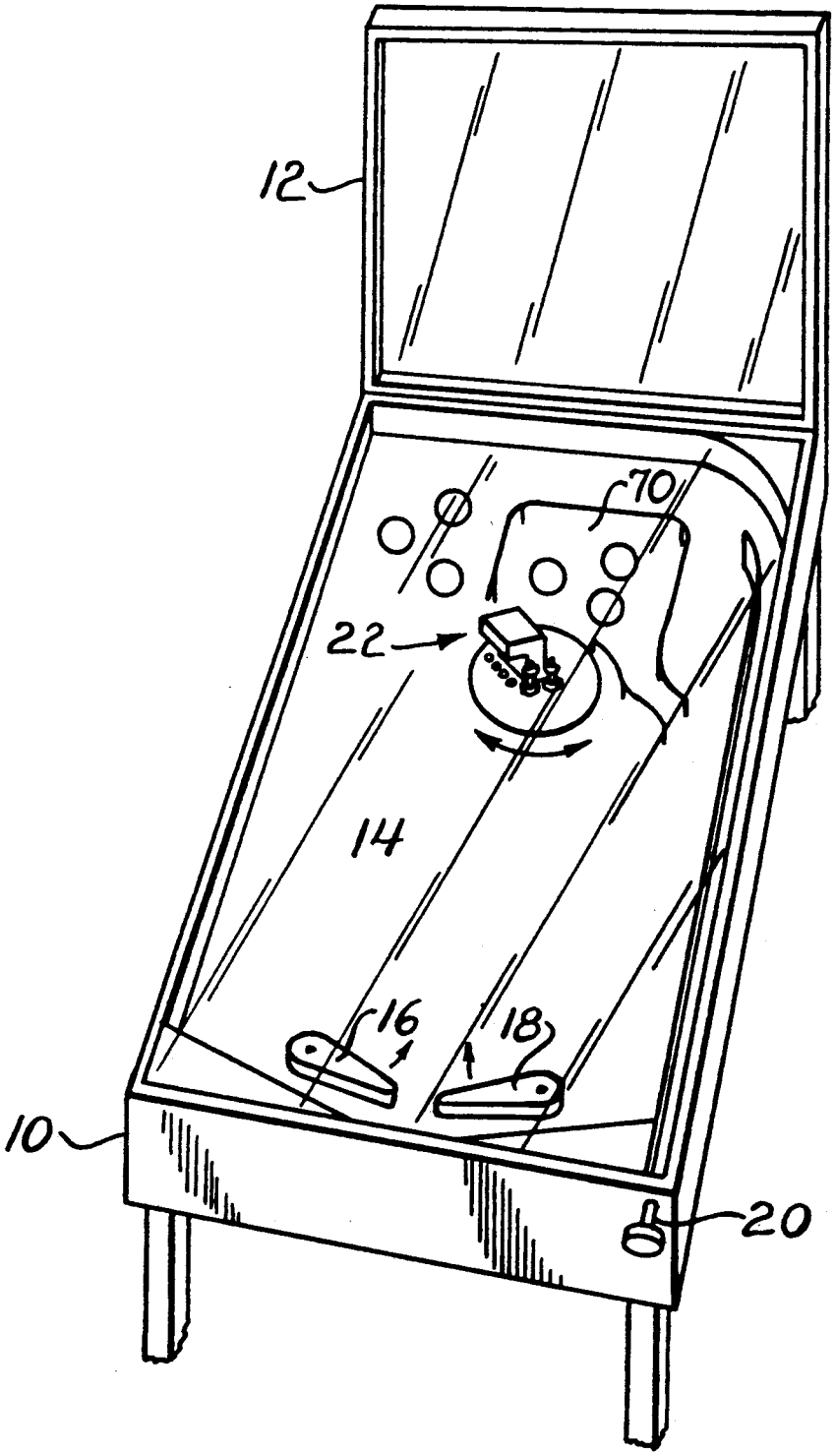
FIG. 1 is a simplified perspective view of a rolling ball game suitable for use with the present invention.

Referring to FIG. 1 a typical rolling ball game is illustrated. The game consists of a cabinet 10 having a back box 12. The cabinet 10 encloses a playfield 14 on which the ball rolls while the back box 12 contains the electronics including the microprocessor along with the scoring displays and other game information. The playfield 14, usually formed of wood, has mounted thereon a plurality of playfield features such as switches, targets, ramps, outholes, etc. as is well known by those skilled in this art. Disposed at the lower, player end of the playfield, is a pair of flippers 16, 18 used to propel the ball at the various playfield features. For purposes of clarity in explaining the present invention, the playfield 14 is shown in a greatly simplified form in which only the feature of the present invention is illustrated as being disposed thereon along with a few other elements, to be described.

In the usual game, play is initiated by the player propelling the ball onto the playfield using a plunger 20 or similar mechanism. The ball rolls onto the playfield near the top portion thereof closest to the back box 12. Because the playfield is tilted, the ball eventually rolls towards the flippers at which time the player can direct the ball at various features. According to the present invention, a rotary optical target bank is associated with the playfield in the manner illustrated in FIGS. 2 and 3. The optical target bank, shown generally at 22 in FIG. 1, is disposed in a circular opening provided in the playfield for that purpose.

Referring to FIGS. 2 and 3, the detailed construction of the invention is disclosed. The target bank 22 is secured to the underside of the playfield 14 by means of a metal bracket 24. The metal bracket may include a number of tab like ends 26 which are screwed into the underside of the playfield to support the feature in the circular opening indicated generally at 28. The playfield feature 22 includes a target housing 30, a target table 32 to which the housing is secured and with which it rotates. The target table 32 is mounted to a shaft 34 for rotation relative to the bracket 24. The shaft 34 is secured to the bracket by means of a bushing 36 and a nut 38 which is threadingly engaged to the bottom of the shaft. A leveling nut 40 is also provided on the shaft whereby the target table 32 can be raised or lowered to ensure that it is flush with the playfield 14 after the bracket 24 has been installed.

In order to rotate the table, a small electric motor 42 is provided, which through a gear box 44, drives a two-bar linkage 46 and 48 mounted in the space between the bracket 24 and the underside of the playfield. The distal end 49 of the link 48 is connected to the underside of the target table by a pin-like member 50 extending downwardly from the underside of the table. The element 49 is secured over the pin 50 by a screw and washer (not shown for clarity) thereby permitting rotation of the pin relative to the end 49. Because the pin 50 is not located at the center of the table, rotation of the motor 42 causes the linkage to rotate the table between the two positions indicated in phantom in FIG. 2.

In order to permit the game microprocessor to monitor the movement of the target table and to detect its position with some accuracy, a pair of micro-switches 52 and 54, are mounted to the bracket 24. As the links 46 and 48 move the table between the two positions, they encounter the switch leaf elements 56 and 58 respectively which activate their corresponding micro-switches thereby to signal the processor.

Contained within the target housing 30 is at least one and preferably two to four optical elements 60 such as light emitting diodes (LED's) or other light emitting elements. Disposed on the underside of the target table 32, directly beneath each optical emitter 60 is an optical detector 62. At the location of each optical detector there is an opening in the target table, preferably a circular opening, which may be filled with a clear element, such as a clear plastic, thereby to permit light to pass from the optical emitter 60, through the clear element directly to the optical detector 62. In effect, this arrangement defines a plurality of vertically disposed optical beams which can be interrupted by the rolling ball when directed at the target housing.

Figure 4:
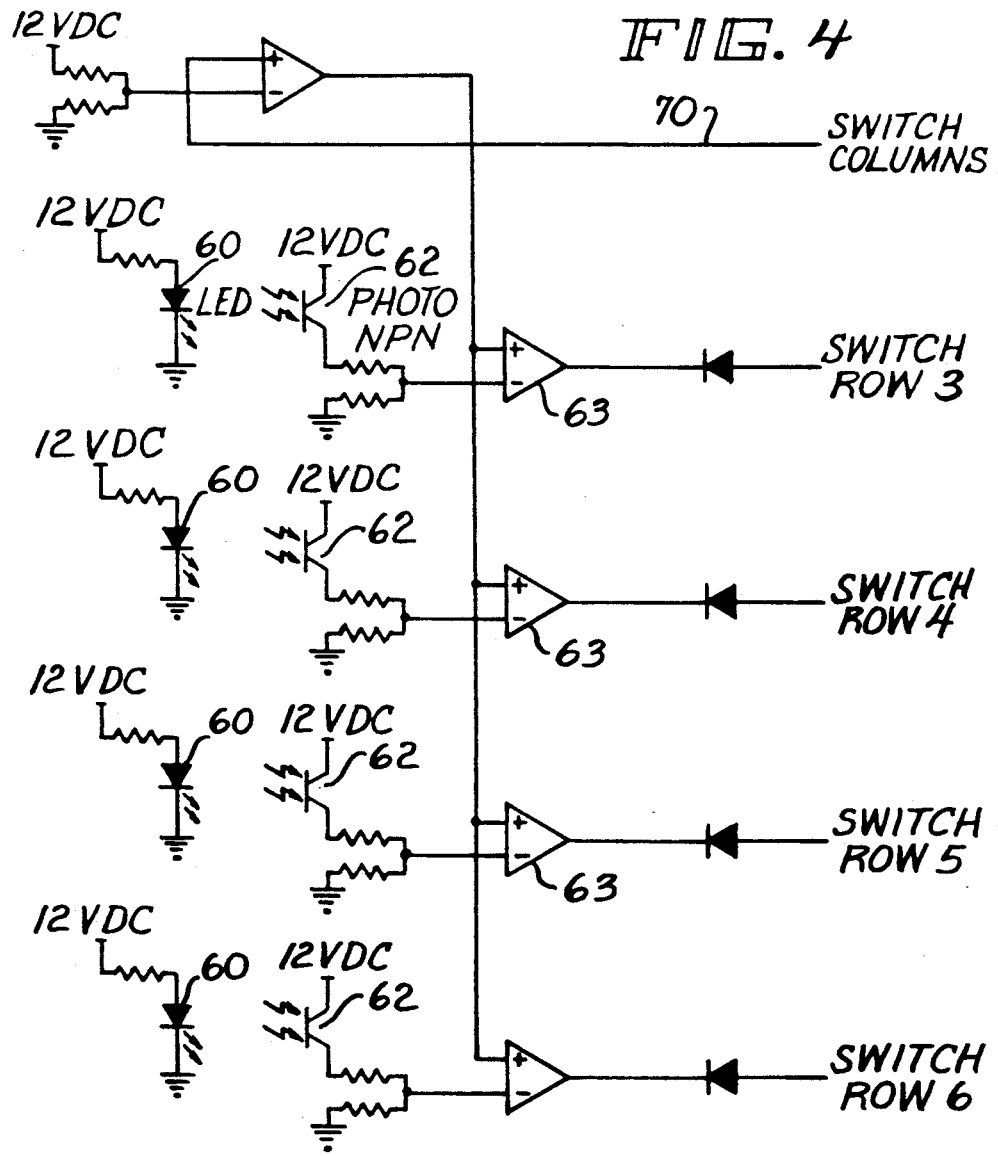
FIGS. 4 and 5 are simplified schematic diagrams illustrating the manner in which the playfield feature of the present invention is interfaced to the game microprocessor.

Depending upon the spacing of the optical beams a rolling ball can interrupt one at a time, or more than one at a time. If there are a plurality of such beams, it can be required that each beam be interrupted before the player is rewarded with rotation of the target table 32 for purposes to be described presently. As shown in FIG. 4, the game processor monitors the beams and is signalled whenever a beam is interrupted. The game processor treats such signals as switch closures of the type which it commonly receives when other playfield features are struck by the ball. In conjunction with the micro-switch information and subject to the rules of the game contained in the processor memory, the playfield feature is preferably controlled in the following manner.

At the start of a game, the target bank is preferably in the position shown in FIG. 2 facing squarely at the player so that he can aim a pinball at each of the optical beams contained within the target housing and target table. The micro-switch 52 is actuated by the linkage to signal the processor that the target bank is in th desired position. Electricity supplied to the optical emitter causes it to create the light beams which are detected by the optical detectors. As play progresses, a player attempts to "make" each of the target beams which is detected when the ball interrupts the beam thereby signalling the processor. When all of the beams have been made, typically four, the processor, as will be explained in connection with FIGS. 4 and 5 activates the motor 42 causing the table 32 to rotate in the direction of the arrows in FIG. 2. This causes the optical beams to be removed from play. The rotation is approximately 90° but of course, any angle between 70° and 120° will be satisfactory for taking the beams out of the line of play.

In a preferred embodiment, as indicated in FIG. 1, there can be a number of playfield features, indicated schematically at 70 which are inaccessible to the player unless the target table has been rotated. These features can be made inaccessible in a variety of ways as, for example, by placing guard rails or other playfield features around them to prevent the ball from accessing the features except when the target table has been rotated approximately 90° from the position shown in FIG. 2. Thus, the playfield feature of the present invention can be employed as an optical target bank and/or an electro-mechanical "gate" controlling access to a restricted portion of the playfield to which access is permitted only as a reward for achieving selected game objectives, which objectives may include but are not limited to, making all of the target beams carried on the table.

When the table has rotated to its second position, the micro-switch 54, will be actuated signalling the processor to discontinue power to the motor. Of course, the processor can maintain control of the motor by timing, but the micro-switches provide a feedback signal which ensures that the processor knows the exact position of the target table.

After access has been granted to the restricted area, the ball will eventually leave the area and return to the main portion of the playfield. Depending upon the rules of the game, it will eventually be desired to return the target table to its initial position for further play or for a new game. This is again accomplished by the processor reactivating the motor 42. The particular two-bar linkage disclosed permits the use of a uni-directional motor although a reversing motor can be used if desired.

Referring now to FIG. 4, a simplified schematic is illustrated indicating the manner in which the optics of the playfield feature are electrically interfaced to the processor system whereby the processor can detect when a ball has interrupted one or more of the target beams. The four LED's 60 are supplied with power from a 12 volt supply. The detector transistors 62 are similarly supplied. The output of transistors 62 are provided, via voltage comparators 63, to the row inputs of a typical switch matrix used by a game microprocessor for reading playfield switches. An enable line 70 from the switch matrix column enables reading of the state of each phototransistor 62.

Figure 5:
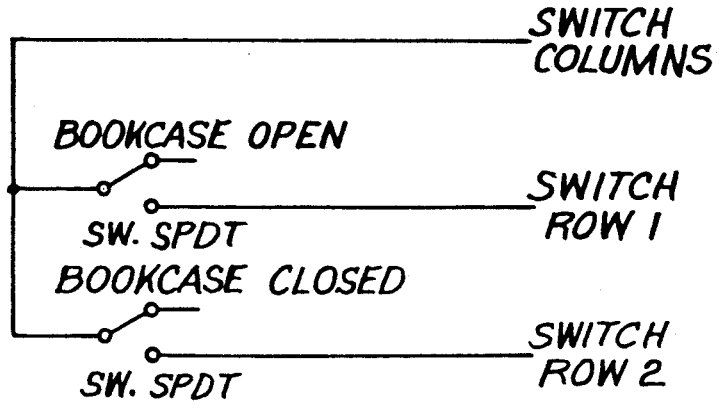

Referring to FIG. 5, the circuit for interfacing micro-switches 52 and 54 is illustrated. The switches are connected in a single column and two different rows of the processors' playfield switch matrix. Each switch is capable of signalling the processor when its leaf element is activated by the two-bar linkage used to rotate the table.

While there has been shown and described a preferred embodiment of the invention, it will be recognized that variations are possible. For example, it is contemplated that the positions of the optical detectors and emitters can be reversed if desired, so that the emitters are in the target table while the detectors are in the upper portion of the target housing. It is also contemplated that a greater or lesser number of target beams can be employed, although two to four is preferred. It will be appreciated that the present invention is a novel playfield feature which serves both as an optical target bank and as a "gatekeeper" controlling access to a restricted portion of the playfield.

What is claimed is:

1. In a computer controlled rolling ball game including an inclined playfield, a ball and means for projecting the ball on the playfield, a playfield feature comprising:

(a) a table mounted flush to said playfield for rotation in an opening therein and on which said ball can roll;

(b) a target housing disposed on said table for movement therewith;

(c) optical emitter and sensor means associated with said playfield feature extending between said housing and said table for creating at least one optical beam which can be interrupted by said ball, said sensor means including means for signalling said computer when a beam is interrupted;

(d) means for rotating said table to change the position of the optical beam.

2. The combination of claim 1 wherein said means for rotating moves the table between:

a) a first position wherein the ball can be propelled at the beam by the projecting means; and b) a second position where the beam is relatively inaccessible to the ball.

3. The combination of claim 2 wherein said target housing restricts access to a selected area of the playfield in said first position and permits access to said selected area in said second position.

4. The combination of claim 1 further including means for leveling said table to maintain it flush with said playfield.

5. The combination of claim 1 wherein said means for rotating includes a motor and a linkage means for connecting said motor to said table for rotation.

6. The combination of claim 1 wherein said means for rotating moves the table between first and second positions and further including means for detecting when the table is in said first and second positions.

7. The combination of claim 6 wherein said detecting means signals the game computer when the table is in the first or second position.

8. The combination of claim 6 wherein said detecting means includes micro-switches.

9. A playfield feature for a game having an inclined playfield and a ball which rolls on said playfield comprising:

a) a table rotatably mounted to said playfield in an opening therein;

b) a target housing disposed on said table for movement therewith;

(c) optical emitter and sensor means associated with said playfield feature extending between said housing and said table for creating at least one optical beam, which can be interrupted by said ball, said sensor means including means for signalling when a beam is interrupted;

(d) means for rotating said table to change the position of the optical beam.

10. The combination of claim 9 wherein said means for rotating moves the table between first and second positions and further including means for detecting when the table is in said first and second positions.

11. The combination of claim 9 wherein said means for rotating includes a motor, and a linkage means for connecting said motor to said table for rotation.

* * * * *